United States Patent [19]

Winchell

[11] 4,068,696

[45] Jan. 17, 1978

[54] SUPPLEMENTAL ADDITIVE INDICATION CAP FOR CONTAINERS AND THE LIKE HAVING AUXILIARY SLEEVE

[75] Inventor: David A. Winchell, Twin Lakes, Wis.

[73] Assignee: Baxter Travenol Laboratories, Inc., Deerfield, Ill.

[21] Appl. No.: 743,185

[22] Filed: Nov. 19, 1976

Related U.S. Application Data

[63] Continuation-in-part of Ser. No. 624,195, Oct. 20, 1975, Pat. No. 4,005,739.

[51] Int. Cl.[2] ..... B65D 33/16

[52] U.S. Cl. ..... 150/8

[58] Field of Search ..... 150/8; 215/247, 216, 215/224, 272, 317, 321; 220/281

[56] References Cited

U.S. PATENT DOCUMENTS

| | | | |
|---|---|---|---|
| 1,316,231 | 9/1919 | Hammer | 215/317 |
| 2,848,130 | 8/1958 | Jesnig | 215/247 X |
| 2,860,802 | 11/1958 | Gold | 215/272 |
| 3,746,001 | 7/1973 | Ralston | 150/8 X |
| 3,854,622 | 12/1974 | McKirnan | 215/216 X |
| 3,871,544 | 3/1975 | Peyser | 215/272 X |
| 4,005,739 | 2/1977 | Winchell | 150/8 |

FOREIGN PATENT DOCUMENTS

| | | | |
|---|---|---|---|
| 52,789 | 6/1944 | France | 215/317 |

*Primary Examiner*—Donald F. Norton

*Attorney, Agent, or Firm*—Paul C. Flattery; Garrettson Ellis; John P. Kirby, Jr.

[57] ABSTRACT

A supplemental additive indication cap for installation about a tubular access port of a container, which defines at one end thereof gripper means such as gripper arms for engaging the access port, to prevent removal of the cap after installation. An auxiliary sleeve is carried by the cap for enclosing the gripper means, to prevent the manual disengagement of the gripper means from the access port and removal of the cap, and also to force the gripper means into engagement with the access port. The cap prevents the addition of further additives such as medication to a parenteral solution container after it is installed.

4 Claims, 3 Drawing Figures

SUPPLEMENTAL ADDITIVE INDICATION CAP FOR CONTAINERS AND THE LIKE HAVING AUXILIARY SLEEVE

CROSS-REFERENCE TO RELATED APPLICATION

This application is a continuation-in-part of application Ser. No. 624,195, filed Oct. 20, 1975 now U.S. Pat. No. 4,005,739.

BACKGROUND OF THE INVENTION

In the administration of medical solutions, and particularly parenteral solutions to patients, sterile containers are used, such as the VIAFLEX ® containers sold by Baxter Travenol Laboratories, Inc. of Deerfield, Illinois. This particular container is a collapsible plastic bag defining a pair of tubular sterile access ports. A needle or a spike can be placed through one of the access ports in order to obtain the contents of the container. Generally, the second access port is provided for the purpose of adding supplemental medication by means of a hypodermic needle. A latex, needle-pierceable stopper is provided over the end of the medication port, to reseal the port after supplemental medication has been administered, and the needle withdrawn.

It is a well known fact, and a continuing hospital problem, that one must be very careful in how supplemental medication is administered to a solution container. For example, although potassium salts are regularly administered as a supplemental medication, the administration of excessive concentrations of potassium salts can cause heart failure. Furthermore, certain combinations of supplemental medications are incompatible and dangerous to the patient.

Accordingly, it becomes a matter of absolute necessity to keep strict track of what has been added to a medication solution container. The careless addition by an overworked nurse of an extra aliquot of potassium chloride supplemental medication, or the accidental addition of two incompatible medications, could result in the injury or death of a patient.

DESCRIPTION OF THE INVENTION

In accordance with this invention, a supplemental medication indication cap for solution containers with a tubular access port is provided. A tubular member, adapted to fit about the tubular access port, defines one end thereof which carries means for irreversibly engaging the access port. Typically, the last named means may comprise a plurality of barbed gripper arms. As specifically shown below, the gripper arms engage the tubular access port in such a manner as to prevent the nondestructive removal of the cap, once it is installed on the access port.

The cap of this invention also carries an auxiliary sleeve, which is positioned about the barbed gripper arms. The sleeve prevents those who would tamper with the indicating cap from being able to open the gripper arms, and thus remove the cap after its installation on a tubular access port.

Furthermore, the inner diameter of the sleeve can be proportioned to hold the barbed gripper arms inwardly, so that the inner portions of the barbs, at their most outwardly extended positions define a circumference which is no larger than the outer diameter of the tubular access port upon which they are to be fitted, the barbs being inwardly and outwardly flexible to a small degree. Preferably, the inner diameter of the sleeve may be proportioned to hold the barbs inwardly, so that their inner tips define a circumference having a diameter which is a few thousandths of an inch less than the outer diameter of the tubular access port, for example about 0.05 inch less, as a preferred dimension.

Accordingly, when one who wishes to tamper with the cap attempts to pull it off of the access port, the barbs dig into the plastic of the access port, tightly retaining the two structures together.

Also, in those cases when the access port includes an elastic, needle-pierceable stopper or injection site of conventional design, the gripper arms may engage the stopper if desired, so that the forced removal of the cap from the access port also causes the removal of the stopper. This results in a loss of sterility in the tubular access port, and thus either prevents its use, or in some circumstances forces the operator to replace this container with a new container.

Alternatively, the cap can be made of such material to cause the gripper arms to break when the cap is forcibly removed. This leaves the cap in a nonresuable condition.

Accordingly, the users of this system are strongly deterred from attempting to shortcut safety precedures utilizing the cap of this invention.

The cap may define a closed, outer end to physically block access of the needle or the like through the tubular access port when installed thereon.

In the drawings, FIG. 1 is a perspective view, with a portion broken away, of the supplemental medication indication cap of this invention, shown prior to installation on a tubular access port of a conventional parenteral solution container.

Figure 1:
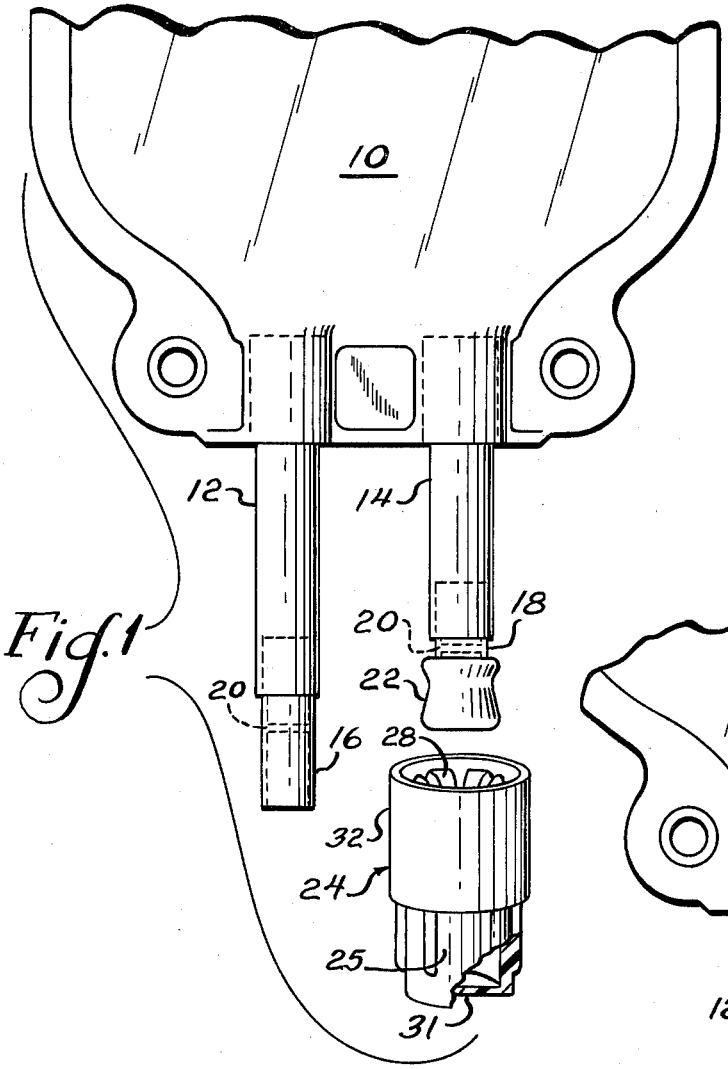

Referring to the drawings, a portion of a sterile solution container 10 is shown, being a heat-sealed plastic bag similar to the VIAFLEX containers described above. Container 10 defines a pair of flexible, plastic tubular access ports 12, 14. Each of the access ports 12, 14 carries a rigid tube 16, 18 having a bore closed off by a diaphragm 20, for sterile sealing of the container 10.

Accordingly, for gaining access to container 10 with a hollow spike in conventional manner, the spike may be inserted into tube 16, to rupture diaphragm 20. Thereafter, the contents of container 10 will flow out through the spike, which is generally part of a sterile parenteral solution administration set.

It is also contemplated that the invention of this application can be used with blood containers as well as sterile solution containers, or for any other desired medical or nonmedical use.

Rigid tube 18 carries a conventional latex resealable injection site 22 about its outer periphery, with the usual portion of the injection site 22 which projects inwardly of tube 18 being not visible in the drawings. Injection site 22 is provided for the addition to container 10 of supplemental medication in a sterile manner by a syringe needle.

Figure 3:
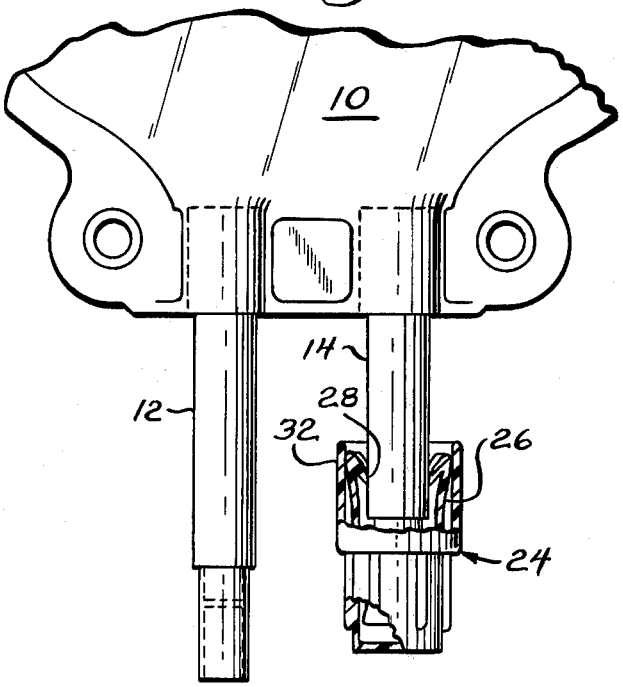
FIG. 3 is an elevational view of the supplemental medication indication cap of this invention, with portions broken away and shown in vertical section, with the cap shown installed on a tubular access port of the sterile solution container of FIG. 1.
Figure 2:
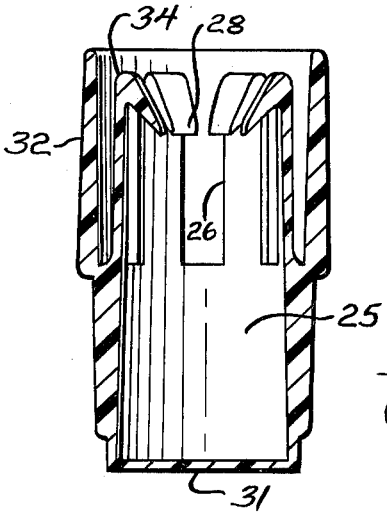
FIG. 2 is a vertical sectional view of the supplemental medication indication cap of this invention.

In accordance with this invention, a supplemental medication indication cap 24 is provided. Cap 24 defines a tubular body 25, adapted to fit about tubular access port 14, which defines at one end thereof a number of grippr arms 26 adapted for irreversibly engaging the access port. Barb members 28 are provided on arms 26 to facilitate gripping. As cap 24 is fitted over the latex injection site 22 and about tube 14, arms 26 are urged outwardly, as shown in FIG. 3, to exert a gripping pressure of barbs 28 against tube 14.

Tubular body 25 defines a closed outer end 31, for physically preventing access to the injection site and tubular port positioned within the cap.

Auxiliary sleeve 32 is carried by cap 24, as shown, to surround gripper arms 26 and their barbed ends 28. Accordingly, once the cap 24 has been installed on tubular access port 14, as shown in FIG. 3, it will be a matter of great difficulty to manually pry gripper arms 26 apart, in an attempt to remove cap 24 from its position on access port 14. This is particularly so when, as is preferred, the inner diameter of sleeve 32 is proportioned to prevent the outward expansion of gripper arms 26 to such a degree that the innermost portions of barbs 28 form a circumference which is equal to or less than the outer circumference of tubular port 14 at their point of engagement, as shown in FIG. 3.

Thus, as cap 24 is emplaced by sliding onto tubular port 14, the barbs 28 slide along the outer surface of tubular port 14, flexing inwardly as necessary about angles 34, to form slightly more acute angles than normal with the main portions of gripper arms 26. However, when one attempts to remove medication indication cap 24 by pulling it off of tubular port 14, the barbs 28 are urged to flex outwardly, to form slightly greater angles than normal with the main portions of gripper arms 26. The tips of the barbs dig into tubular port 14, since arms 26 are prevented from moving outwardly by sleeve 32. Thus, the barbs provide firm retention of cap 24 on tubular port 14. To facilitate this, barbs 28 preferably define an acute angle of about 30° to 45° with the axially extending portions of gripper arms 26, and constitute integral extensions thereof.

Specifically, the inner diameter of sleeve 32 may be 0.652 inch, adjacent its outer end, but tapering slightly inwardly towards its inner end at about a 1° angle, to facilitate molding. The remaining dimensions of the medication cap of this invention may be proportionate to the above.

The above has been offered for illustrative purposes only, and is not to be understood as limiting the invention of this application, which is as defined in the claims below.

That which is claimed is:

1. A supplemental additive indication cap adapted for installation on a tubular access port of a container, said cap defining at one end thereof a plurality of gripper arms, said gripper arms being positioned to engage said tubular access port upon attempted removal of the cap from the access port to prevent removal thereof, and a sleeve, carried by said cap and immovably positioned about said gripper arms, to prevent the manual disengagement of the arms while the cap is positioned on the tubular access port, the innner diameter of said sleeve being proportioned to enhance the gripping of said access port by the gripper arms by preventing the outward displacement of said gripper arms beyond a predetermined limit.

2. The supplemental additive cap of claim 1 in which said gripper arms define barbed portions for gripping said tubular access port.

3. The supplemental additive indication cap of claim 2, positioned on a tubular access port of a container, the inner diameter of said sleeve being sufficiently small so that the innermost portions of the barbed portions of said gripper arms are positioned about a circumference which is less than the circumference of said tubular access port at the point of engagement with said barbed portions, said barbed portions being adapted to flex inwardly.

4. The tubular access port and supplemental additive indication cap of claim 3 in which said access port carries at its outer end, within said cap, an elastic, needle-pierceable injection site, whereby said cap prevents access through said elastic injection site.

* * * * *